US007484902B2

(12) United States Patent
Pomfret

(10) Patent No.: US 7,484,902 B2
(45) Date of Patent: Feb. 3, 2009

(54) RIBBON CASSETTE FOR MAILING MACHINE

(75) Inventor: John A. Pomfret, East Lyme, CT (US)

(73) Assignee: Cartec International, Inc., Canton, CT (US)

( * ) Notice: Subject to any disclaimer, the term of this patent is extended or adjusted under 35 U.S.C. 154(b) by 563 days.

(21) Appl. No.: 11/338,167

(22) Filed: Jan. 24, 2006

(65) Prior Publication Data

US 2007/0172286 A1 Jul. 26, 2007

(51) Int. Cl.

| | |
|---|---|
| ***B41J 31/00*** | (2006.01) |
| ***B41J 32/00*** | (2006.01) |
| ***B41J 32/02*** | (2006.01) |
| ***B41J 35/08*** | (2006.01) |

(52) U.S. Cl. ..... 400/208; 400/207; 347/214

(58) Field of Classification Search ..... 400/120.01–120.04, 191–196, 207–208.1, 400/223, 234–236.2, 242–244, 248; 347/171, 347/214

See application file for complete search history.

(56) References Cited

U.S. PATENT DOCUMENTS

| | | | | | |
|---|---|---|---|---|---|
| 4,908,632 | A | * | 3/1990 | Ishikawa et al. | 347/197 |
| 5,044,794 | A | * | 9/1991 | Shimoyama et al. | 400/208 |
| 5,304,008 | A | * | 4/1994 | Asakura et al. | 400/234 |
| 5,318,368 | A | * | 6/1994 | Fogle et al. | 400/208 |
| 5,355,152 | A | * | 10/1994 | Porter et al. | 347/214 |
| 5,619,244 | A | * | 4/1997 | Manna | 347/214 |
| 5,917,532 | A | * | 6/1999 | Cornell et al. | 347/214 |
| 5,959,652 | A | * | 9/1999 | Privin | 347/214 |

* cited by examiner

*Primary Examiner*—Jill E. Culler
*Assistant Examiner*—'Wyn' Q Ha
(74) *Attorney, Agent, or Firm*—Ira S. Dorman

(57) ABSTRACT

A thermal ink ribbon cassette for a mailing machine has an anti-reverse spring for preventing rotation of the take-up spindle in the unwinding direction; a constant-tension drag arrangement, including an expansible stub axle, a cooperating expansion member, and a drag gear mounted on the stub axle in meshing engagement with an array of gear teeth surrounding the base of the ribbon supply spindle; and a guide bar for defining an optimal ribbon path between the entrance opening of the cassette housing and the take-up spindle.

22 Claims, 6 Drawing Sheets

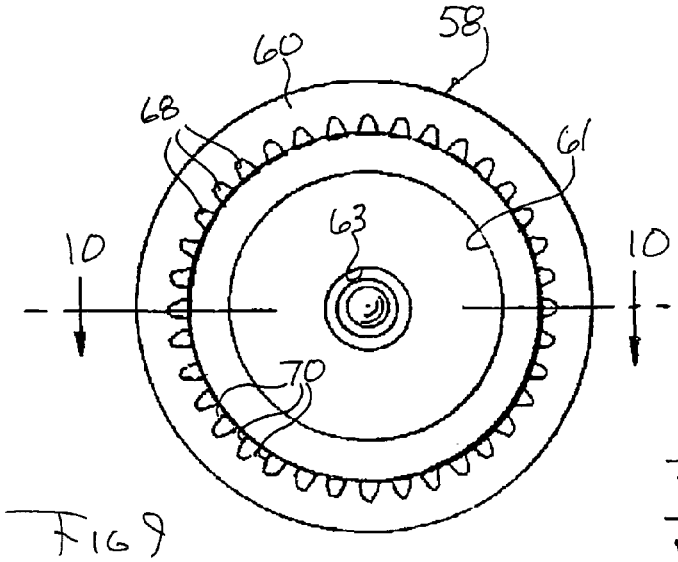
FIG 9
FIG 6
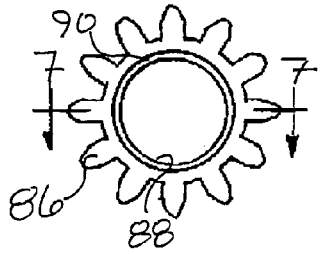
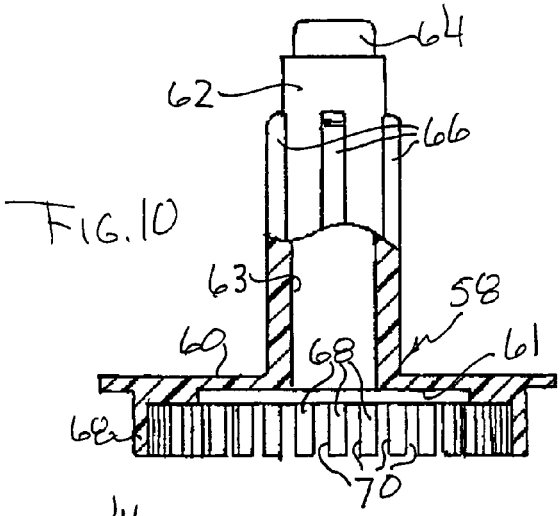
FIG. 10
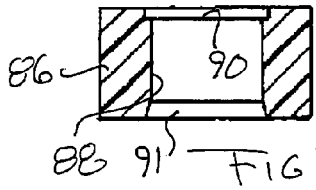
FIG 7
FIG. 8
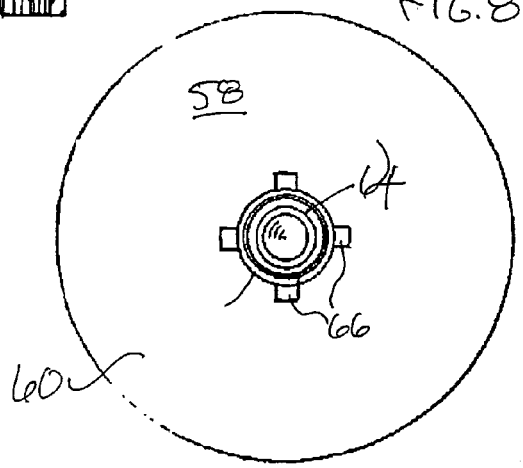
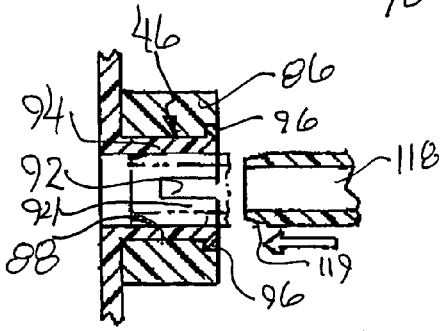
FIG. 5

RIBBON CASSETTE FOR MAILING MACHINE

BACKGROUND OF THE INVENTION

Mailing machines are of course in common use for applying postage to envelopes. Such machines now typically employ a thermal ink ribbon, comprised of a thin plastic film coated with a fusible layer comprising an ink composition, which composition is transferred, in selected patterns for printing postage and graphics, to an envelope passed in contact therewith under a thermal print head of the machine.

U.S. Pat. No. 5,959,652 provides a concise description of such a mailing machine and a thermal ink ribbon cassette suitable for use therein. The disclosure of that patent, at lines 13 through 49 in column 1 and at line 32 of column 5 to line 58 of column 6, together with FIG. 1, is hereby incorporated here-into by reference thereto. The following U.S. Pat. Nos. are also of interest to the present invention: 4,908,632; 5,192,149; 5,392,148; 5,529,410; 5,619,244; 5,917,532; 5,933,179; and 6,301,522.

Despite the extensive efforts that have been devoted to the development of thermal ink ribbon cassettes for mailing machines, of which the foregoing prior art is indicative, improvements in the design and construction of such cassettes would of course be desirable. In particular, although the need for establishing and maintaining a proper tension upon the ink ribbon has been well recognized and addressed, it is not believed that optimal means for doing so has heretofore been provided. Moreover, while suitable anti-reverse mechanisms are known for preventing unwinding of the used ribbon from the take-up spindle, in their present forms such mechanisms tend to be unduly complex, not entirely effective, or both.

SUMMARY OF THE INVENTION

Accordingly, it is the broad object of the present invention to provide a novel ink ribbon cassette for a mailing machine, and in particular a thermal ink ribbon cassette, which avoids certain disadvantageous features of the cassettes known in the art and currently commercially available.

More specific objects of the invention are to provide such an ink ribbon cassette wherein tension control and anti-reverse functions are achieved by means that are highly effective and yet relatively uncomplicated, thereby affording advantages in use and in the cost and facility of manufacture.

It has now been found that certain of the foregoing and related objects of the invention are attained by the provision of an ink ribbon cassette comprised of a housing, ribbon supply and ribbon take-up spindles, an anti-reverse spring, a constant-tension drag arrangement, a ribbon guide bar, and an ink ribbon supply. The housing of the cassette is comprised of an assembled base component and mating cover component, secured to one another and defining an interior space therewithin. The base component comprises a back wall, which faces rearwardly in the normal orientation of cassette operation, and the cover component comprises a front wall which faces forwardly, the front and back walls normally being of generally planar form. One of the housing components includes a peripheral wall that comprises an upper portion, a transversely spaced lower portion, and laterally spaced opposite end portions. The lower portion of the peripheral wall is formed with an upwardly extending recess for receiving the print head assembly (i.e., the print head and the mounting bracket) of a mailing machine, the recess being defined by an upper wall section and first and second lateral wall sections, spaced laterally from one another. The lower portion of the peripheral wall has an exit opening adjacent to and upstream of the first lateral wall section that defines the print head assembly recess, and it has an entrance opening adjacent to and down-stream of the second lateral wall section, the upstream and downstream references being expressed with respect to the direction of ribbon travel from the supply side to the take-up side of the cassette.

The ribbon supply and take-up spindles are rotatably mounted upon the base component of the housing, within the interior space and on the supply side and take-up side of said cassette, respectively. Each spindle comprises a circular base having an array of gear teeth extending about its circumference, and a center shaft extending substantially normal to the base for supporting a roll of fresh or used printing ribbon, as the case may be.

The anti-reverse spring is mounted upon the housing and has an outer end portion in engagement with the gear teeth of the take-up spindle. The spring is so configured and disposed as to permit rotation of the take-up spindle in its forward, ribbon-winding direction while preventing rotation in the reverse, ribbon-unwinding direction thereof.

The constant-tension drag arrangement is comprised of a radially expansible stub axle, which projects forwardly from the base component and has a bore extending thereinto, from a free forward end, on an axis substantially normal to the back wall; a expansion member that projects rearwardly from the cover component, substantially normal to the front wall, into the bore of the stub axle so as to cause the stub axle to be presented it in an expanded state; and a gear (normally a spur gear) that has an axial aperture through which the stub axle extends for rotatable mounting of the gear, the stub axle being positioned to dispose the mounted gear in meshing engagement with the gear teeth of the supply spindle. The parts of the drag arrangement are so dimensioned and configured that, in the expanded state of the stub axle a surface portion thereof frictionally engages the surface defining the gear aperture with a force that is sufficient to retard rotation of the gear and thereby to exert a significant drag force, of substantially constant magnitude, upon the supply spindle; such a drag force contributes to the maintenance of a substantially constant level of tension upon the printing ribbon.

The guide bar extends transversely of the interior space within the housing, substantially normal to the opposite walls of the base and cover components and near the entrance opening in the lower portion of the peripheral wall. A surface on the guide bar is offset laterally from a line that spans the lower edge of the "second" lateral wall section of the print head assembly recess and the center shaft of the take-up spindle, the direction of offset being to the side of the spanning line opposite to the that on which the lower edge of the second wall section is disposed. The housing is desirably devoid of any wall portion in the area between the lower edge of the second lateral wall section and the take-up spindle, such as would provide underlying support for the printing ribbon during its passage therebetween.

The fresh roll of postage-printing ribbon is supported on the supply spindle in fixed relationship thereto, and an end portion of the ribbon is attached to the take-up spindle, which spindle is driven by the mailing machine motor. The ribbon travels along a path from the supply spindle, outwardly of the housing through the exit opening, over the lower edges of the first and second lateral wall sections to span the print head assembly-receiving recess, back into the housing through the entrance opening, about the guide surface of the guide bar and finally to the take-up spindle for winding thereupon.

In most embodiments of the invention, the cover component and the peripheral wall of the cassette housing will be integrally formed as a single piece (e.g. of molded plastic), with the peripheral wall extending generally perpendicular to the front wall of the cover component. One of the housing components will beneficially be formed with a multiplicity of fastening elements spaced thereabout and projecting therefrom toward the other housing component, for fixed engagement in holes formed into the confronting edge portion of the peripheral wall to secure the housing components in assembly. The first and second lateral wall sections that define the print head-receiving recess in the lower portion of the peripheral wall will desirably be of the same transverse length, and will normally terminate in smooth free edges of curvilinear cross section.

The base of the supply spindle will preferably have a circumferential flange formed with a multiplicity of substantially identical gaps therethrough, at equiangularly spaced locations entirely thereabout, so as to provide the array of gear teeth thereon. The gear teeth on the base of the take-up spindle will preferably extend radially outwardly therefrom, and the array will advantageously have an identifiable upper and lower zones, with engagement of the anti-reverse spring being limited substantially to the upper zone. The anti-reverse spring will desirably have an inner end portion mounted adjacent the upper portion of the peripheral housing wall. In such embodiments one of the housing components is formed with structure for disengageably receiving the inner end portion of the anti-reverse spring, the other housing component being formed with means for maintaining the end portion of the spring in such assembly.

The constant-tension drag arrangement will preferably comprise a hollow post that is axially split, at a plurality of locations and from its free forward end, to define a plurality of segments that are radially displaceable, by the expansion member, to the expanded state. Preferably, the expansion member will comprise a rod that extends rearwardly, generally normal to the front wall of the cover component.

The guide bar employed in the cassette will usually be rectilinear, with a smooth, curvilinear outer surface portion (taken in cross section) providing the guide surface and extending along a substantial portion of its length. A free end portion of the guide bar will desirably be disposed in contact with the confronting housing component wall, and will be formed with a hole in which a fastening element on the confronting wall is seated and engaged.

The "second" lateral wall section that defines the print head assembly recess will usually be of compound construction and will have a segment, adjacent the front wall of the cover component, that is spaced laterally beyond the remaining segment of the second lateral wall section so as to cooperatively provide a thumb-receiving recess structure, which protrudes into the interior housing space. The guide bar of the cassette serves to displace the printing ribbon so as to cause it to follow a path that avoids interference with the inwardly protruding recess structure.

BRIEF DESCRIPTION OF THE DRAWINGS

FIG. 5 is a fragmentary sectional view, taken along line 5-5 in FIG. 4 and drawn to an enlarged scale, showing the stub axle and the spur gear rotatably mounted thereupon, and the expansion rod positioned for entry thereinto;

FIG. 6 is a plan view of the spur gear depicted in FIGS. 4 and 5, drawn to a further enlarged scale;

FIG. 7 is a sectional view of the spur gear, taken along line 7-7 in FIG. 6;

FIG. 8 is a plan view of the ink ribbon supply spindle utilized in the cassette;

FIG. 9 is bottom view of the supply spindle;

FIG. 10 is an elevational view of the supply spindle, shown in partial section taken along line 10-10 in FIG. 9;

DETAILED DESCRIPTION OF THE ILLUSTRATED EMBODIMENT

Figure 2:
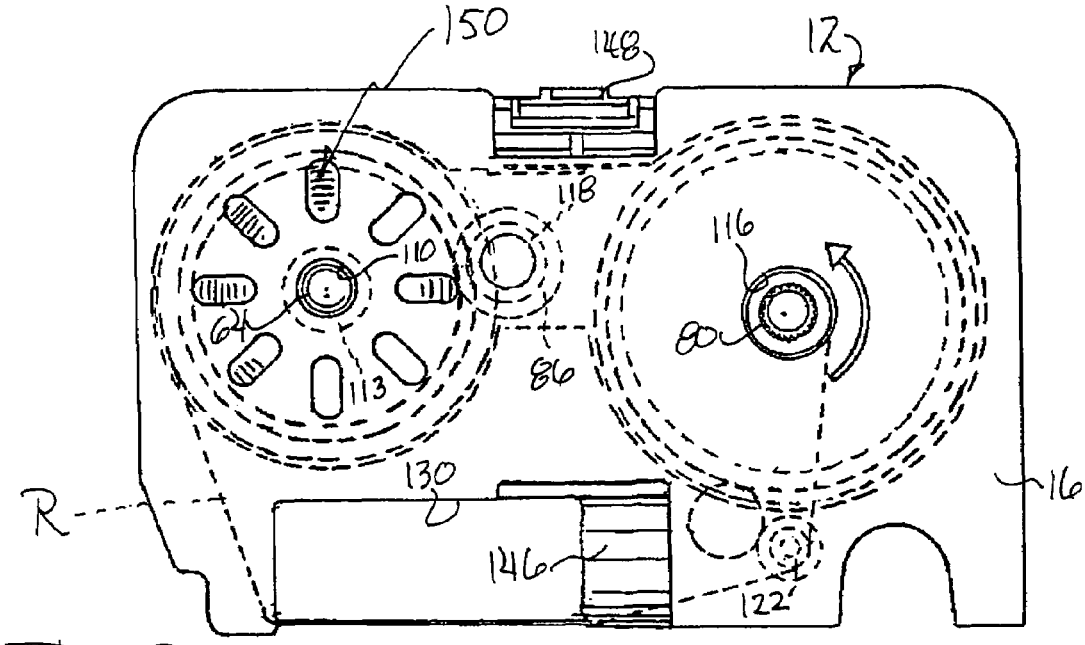
FIG. 2 is a plan view of the cassette of FIG. 1, showing internal features in dotted line.

Turning now in detail to the appended drawings, therein illustrated is an ink ribbon cassette, for a mailing machine, embodying the present invention and including a housing comprised of a base component, generally designated by the numeral 10, and a cover component generally designated by the numeral 12. Both components of the housing are integrally formed, each a single piece, such as by molding of a suitable thermoplastic or thermosetting synthetic resinous material (e.g., an ABS plastic).

As mounted in its normal operating orientation in a mailing machine, the base component 10 provides the back wall 14 of the cassette and the cover component 12 provides the front wall 16 thereof; a peripheral wall, generally designated by the numeral 18, extends about the front wall 16 and is integrally formed therewith as a portion of the cover component 12. Several pins 20 project normal (i.e., forwardly) from the raised edge 22 that surrounds the back wall 14, and are engaged in corresponding holes 24 formed into the confronting edge of the peripheral wall 18, thereby serving to secure the base and cover components 10, 12 in assembly, which together thereby define an interior space 26 within the housing.

A pair of circular recesses 28, 30 are molded into the back wall 14 of the base 10 on the supply side and the take-up side of the cassette, respectively, as is short interconnecting channel 32. An elevated circular platform 34, with a forwardly projecting central hub element 36, is concentrically formed within the recess 28 and serves to rotatably support a ribbon supply spindle, generally designated by the numeral 58. A pair of openings 38, 40 extend through the back wall 14 of the base component 10 and serve to receive elements of the optical sensing system that is provided in the mailing machine.

A cylindrical hub element 42 projects forwardly and concentrically within the take-up side recess 30, and serves to rotatably support a take-up spindle, generally designated by the numeral 72. A circular aperture 44 is provided in the back wall 14 and serves to receive the ribbon-transport drive gear 156, best seen in FIG. 4 of the drawings and which is driven by the mailing machine motor (not illustrated).

An axially split stub axle element, generally designated by the numeral 46, projects forwardly from the back wall 14 within the connecting channel 32. A finger element 48, joined at one end to the channel-defining structure of the base component 10, extends laterally along the channel 32 and defines an open-ended slot 50. Short tabs 52, 54 project forwardly, at spaced locations along the raised edge 22 of the base, and another short tab 56 extends laterally therefrom; tabs 52, 54 facilitate registry and assembly of the base component 10 with the cover component 12; tab 56 cooperates with the mailing machine for mounting purposes.

As is best seen in FIGS. 8-10, the supply spindle 58 consists of a circular base portion 60, from which extends a central shaft portion 62 having a forward end element 64 of reduced diameter; four splines 66 extend axially along the shaft portion 62 at equiangularly spaced locations. A shallow circular recess 61, formed into underside of the base portion 60, communicates with the bore 63 that extends forwardly into the shaft portion 62; as will be appreciated, the recess 61 receives the elevated platform 34 on the back wall 14 and the bore 63 receives the central hub element 36 thereon, to rotatably mount the supply spindle 58 on the base component 10.

A cylindrical skirt extends downwardly (rearwardly) from the underside of the circular base portion 60, and provides a circumferential array of gear teeth 68 with intervening gaps 70. In addition to serving a mechanical function (described below), the gear teeth 68 and (more particularly) the gaps 70 serve to regularly interrupt the light beam generated by the optical sensor system of the mailing machine, thereby generating a supply spindle rotation rate-dependent pulse for controlling movement of the printing ribbon through the cassette, and hence through the mailing machine.

Figure 13:
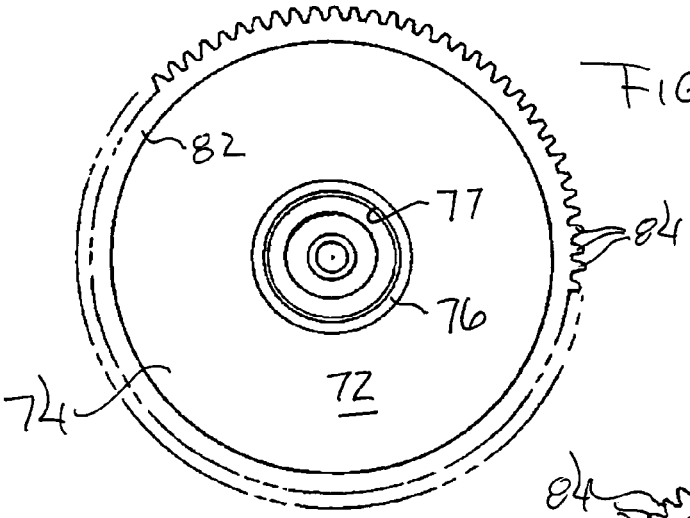
FIG. 13 is a plan view of the take-up spindle utilized in the cassette.
Figure 14:
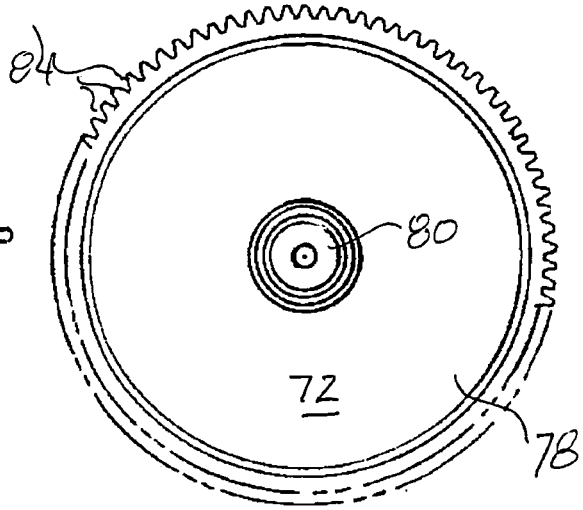
FIG. 14 is a bottom view of the take-up spindle.
Figure 15:
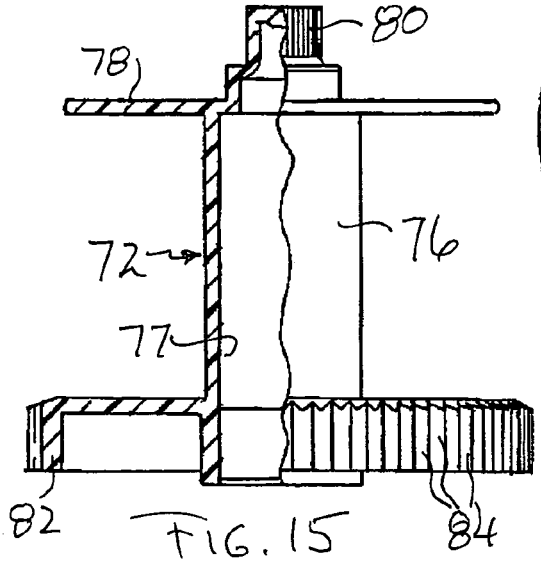
FIG. 15 is an elevational view of the take-up spindle, in partial section.

The take-up spindle 72 is most fully illustrated in FIGS. 13-15 and, like the supply spindle 58, consists of a circular base portion 74 having an upstanding hollow central shaft portion 76 extending forwardly therefrom, on an axis normal to the plane of the base portion 74, and a depending circumferential skirt portion 82 extending thereabout. A disk element 78 is formed near the forward end of the shaft portion 76, and a knurled knob element 80 projects coaxially therefrom (to permit facile manual rotation of the take-up spindle). The lower end of the shaft portion 76 is open, for rotatably mounting the spindle 72 with the cylindrical collar portion 42 on the back wall 14 of the base 10 received in the bore 77; an array of gear teeth 84, formed on the exterior of the depending skirt portion 82, surrounds the base portion 74 of the spindle. Needless to say, both spindles 58, 72 will normally be molded from a suitable synthetic resinous material As is best seen in FIGS. 3-7, a spur gear 86 is rotatably mounted upon the stub axle 46, which extends through its axial aperture 88. The aperture 88 is enlarged adjacent at its forward (upper) end, to provide a circumferential shoulder 90, and it has a tapered lead-in section 91 at its rearward (lower) end. The structure forming the stub axle 46 is axially slotted downwardly, from its upper end, at each of four equiangularly spaced locations 92 so as to form four expansion sections 94 which are resiliently deflectable in radial directions. The outwardly de-flected sections 94 effectively expand the axle 46 circumferentially, engaging the inside surface of the gear 86 defining the axial aperture 88 and thereby producing a drag force of constant magnitude thereon; the spur gear 86 is freely rotatable upon the stub axle 46 when the sections 94 are in a non-deflected, relaxed condition. As will be appreciated, the lead-in taper 91 facilitates assembly of the spur gear 86 upon the stub axle 46, and the shoulder 90 serves to seat the lip elements 96, formed on the free outer ends of the axle sections 94, to thereby lock the gear 86 against disassembly from the stub axle 46.

Figure 3:
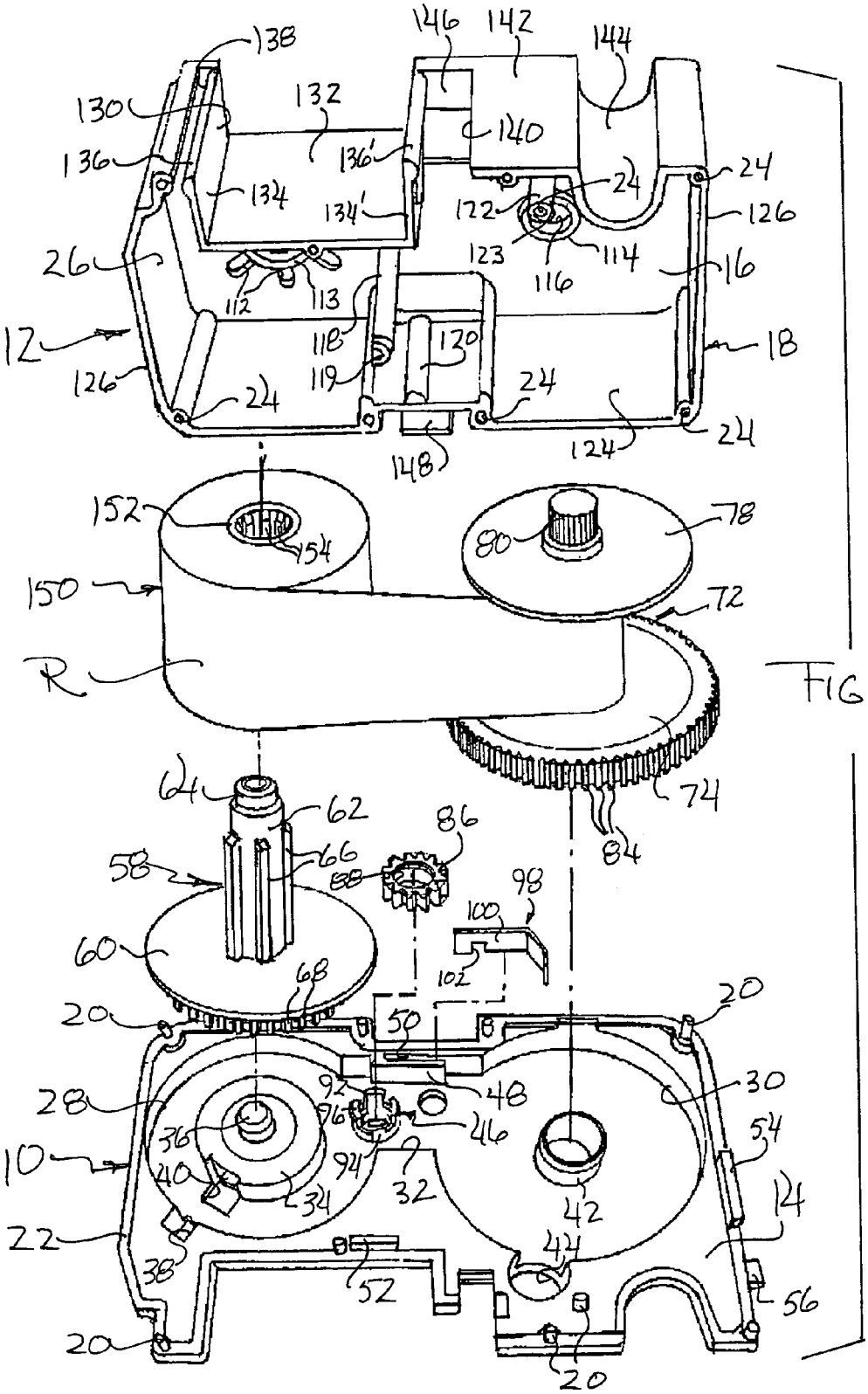
FIG. 3 is an exploded perspective view, depicting the cassette of the fore-going figures.
Figure 16:
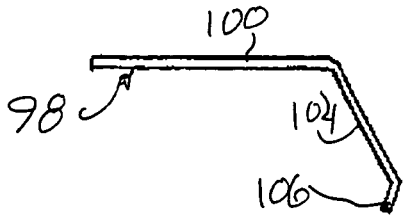
FIG. 16 is an edge view of the anti-reverse leaf spring utilized in the cassette, as shown in FIGS. 1-4 and drawn to a scale greatly enlarged therefrom.
Figure 17:
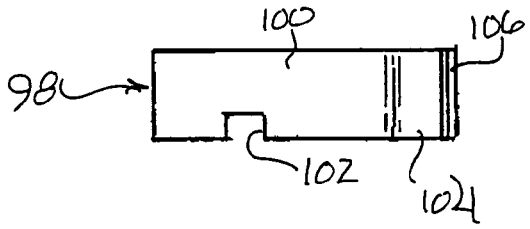
FIG. 17 is an elevational view of the anti-reverse leaf spring.
Figure 18:
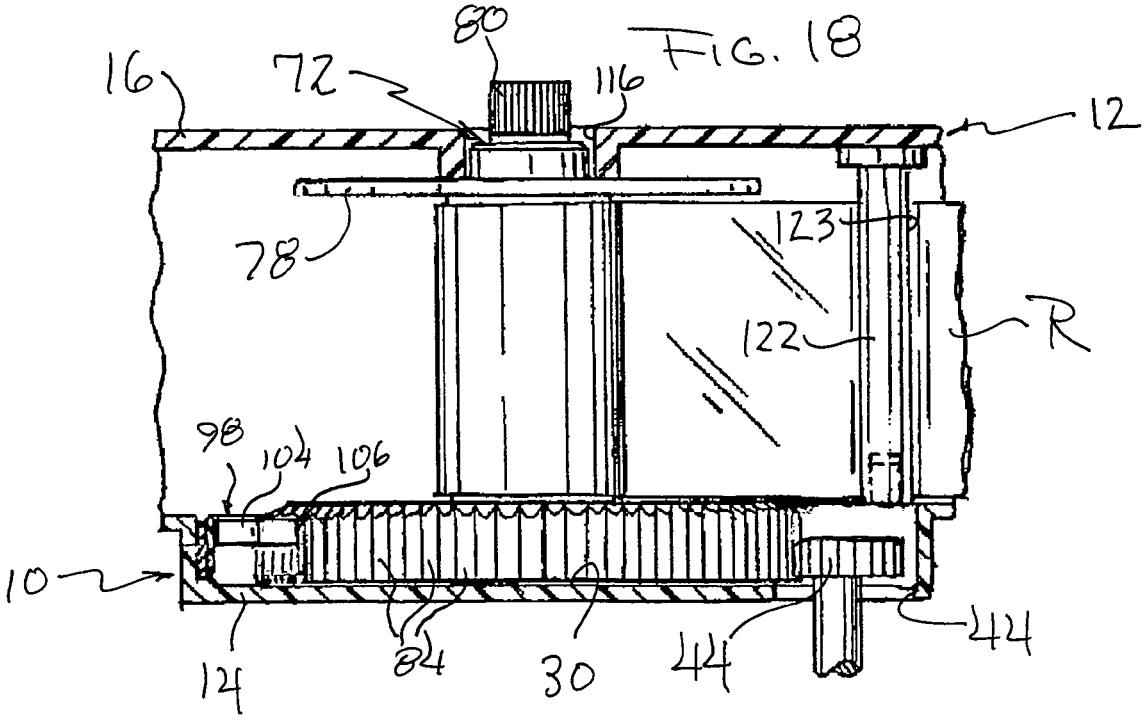
FIG. 18 is a fragmentary elevational view, taken along line 18-18 in FIG. 4, showing the anti-reverse leaf spring in engagement with an upper zone of the array of teeth on the base of the take-up spindle, and showing the mailing machine drive gear in meshing engagement with a lower zone of the array of teeth.

Turning now in greater detail to FIGS. 16 and 17, the anti-reverse leaf spring, generally designated by the numeral 98, will normally be made of spring steel and is seen to comprise a mounting leg 100 having a notch 102 formed into one edge, intermediate leg 104 disposed at an obtuse angle to the leg 100, and a terminal contact element 106 disposed at an obtuse angle to the leg 104. As indicated in FIG. 3, and depicted in FIG. 4, the mounting leg 100 of the spring 98 is seated within the slot 50 formed behind the finger 48; the leg 104 extends from the slot 50, and positions the element 106 in engagement with the array of gear teeth 84 surrounding the base 78 of the take-up spindle 72. Although not visible, a small protrusion extends upwardly into the slot 50, from the back wall 14 of the housing base, and engages in the notch 102 in the leg 100 so as to prevent lateral displacement of the spring 98 from the slot; an element (to be described presently) on the cover component 12 serves to hold the leaf spring 98 downwardly against upward displacement. As is shown in FIG. 18, the leaf spring 98 bears upon an upper zone (taken with reference to a transaxial plane through the skirt portion 82) of the circumferential array of gear teeth 84 on the take-up spindle 72.

With more particular reference to the cover component 12 of the cassette housing, the front wall 16 has a circular hole 110 formed therethrough, concentric with which are an arrangement of radially extending oval slots 112 (which serve to enable visual inspection of the remaining supply of fresh ribbon) and a rearwardly projecting hold-down ring structure 113 (for stabilizing the supply spindle 58). A ring clement 114 is similarly provided on the take-up side of the cassette, and is disposed coaxially with the circular hole 116 for stabilizing the take-up spindle 72.

Also depending from the front wall 16 of the cover component 12 is an expansion rod 118, which is of generally cylindrical cross section but is relieved along one side to provide clearance for the spindle 58; the free end 119 of the rod 118 is tapered. As will be evident, when the cover and base components of the housing are assembled the rod 118 is inserted into the bore of the stub axle 46, thereby deflecting outwardly the sections 94 and creating a drag force on the spur gear 86, as previously described. Because the rod 118 is relieved along one side, it will generally deflect only three of the sections 94; the resulting increase in effective cross section will nevertheless produce the desired frictional drag force upon the spur gear.

A half-round rib 120 extends transversely along the inside surface of wall structure comprising the upper portion 124 of the peripheral wall 18, and provides the element (previously referred to) for retaining the leaf-spring 98 in the slot 50 against forward displacement, it being evident that the flat rearward end of the rib 120 overlies the leg 100. A hole 24 extends into the free end of the depending cylindrical guide bar 122 for engaging an aligned fastening pin 20 formed on the back wall 14 of the base component 10.

The peripheral wall 18, integrally formed on the cover component 12, comprises an upper portion 124 and opposite end portions 126. The lower portion of the peripheral wall 18 is formed with a rectangular recess 130, which serves to receive the print head and the head-mounting bracket of the printing machine. The recess 130 is defined by an upper wall section 132 and two laterally spaced lateral wall sections 134, 134', each of which terminates as a smoothly rounded lower free edge element 136, 136'. The edge element 136 on the upstream side of the cassette (taken with reference to the direction of ribbon movement) cooperates with the closely adjacent peripheral wall structure to define a narrow exit slot 138; the edge element 136' on the downstream side is spaced substantially from the adjacent peripheral wall section 142 (which is flat, and substantially parallel to the upper wall section 132 and the upper wall portion 124) so as to define a relatively wide entrance gap or opening 140. It should be appreciated that the two lateral wall sections 134, 134' are of virtually the same transverse length, sufficient to ensure slight spacing between the length of printing ribbon that spans the recess 130 and the print head and mounting bracket seated therein.

The flat wall section 142 of the peripheral wall joins a semi-circular section 144, which defines an indentation into the lower portion of the housing for receiving the envelope-drive roller of the mailing machine. As is also conventional in cassettes of the present kind, latching structure 148 is formed on the upper portion 124 of the peripheral wall 18 and serves to disengagably secure the cassette in operative position within the cavity provided in the mailing machine.

Figure 1:
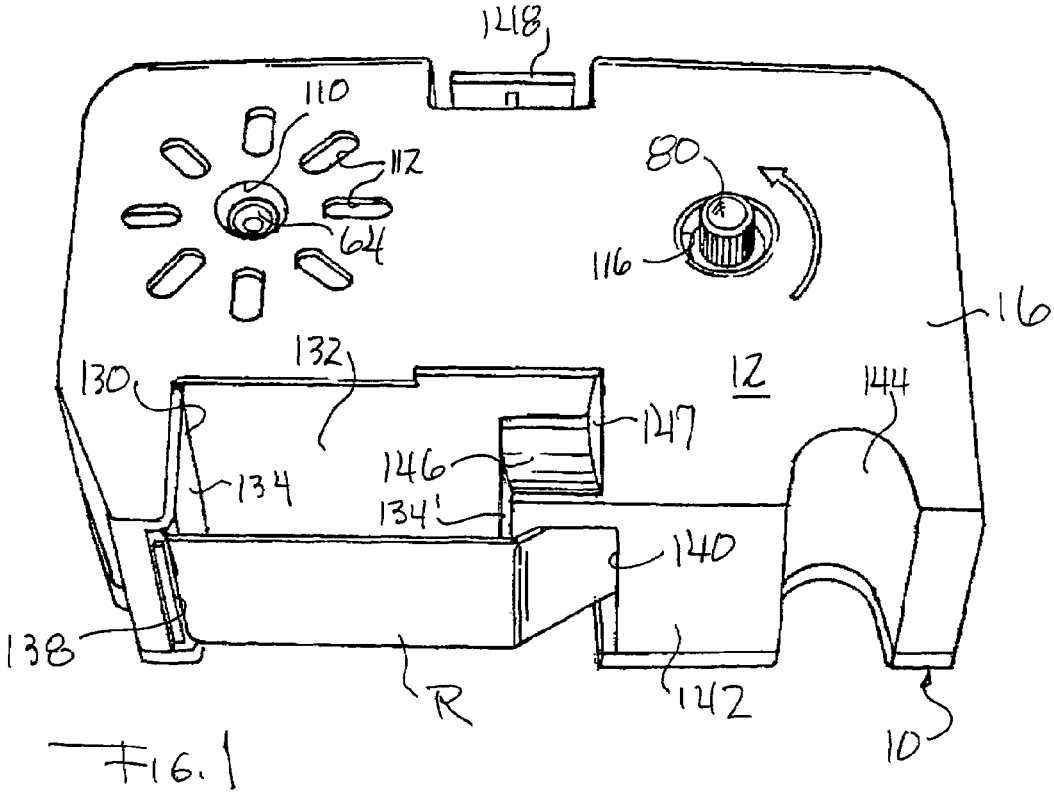
FIG. 1 is a perspective view of an ink ribbon cassette embodying the present invention.

As is best seen in FIGS. 1 and 2, a curved wall section 146 extends inwardly from the front wall 16 of the cassette, adjacent the straight wall section 142 and toward the upper peripheral wall portion 124. The curved wall section 146 cooperates with the laterally offset wall segment 147 to provide a "thumb-print" area for gripping of the cassette to facilitate insertion into and removal from the mailing machine. It will be appreciated that the curved wall section 146 and the laterally offset segment 147 of the wall section 134' extend into the space 26 within the housing.

Figure 11:
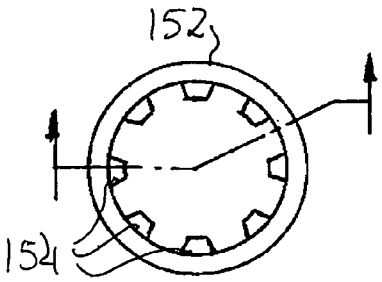
FIG. 11 is an end view of the core upon which a fresh roll of ink ribbon is wound, for mounting upon the supply spindle.
Figure 12:
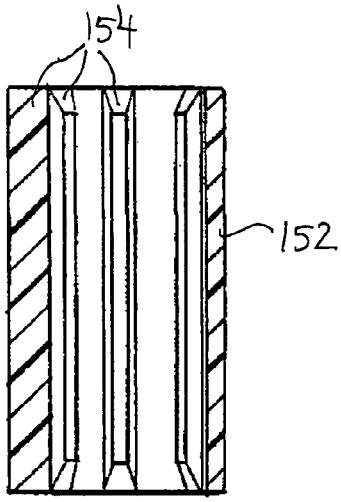
FIG. 12 is a sectional view of the core of FIG. 11, taken along line 12-12 therein and drawn to an enlarged scale.

The ribbon "R" is supplied as a so-called "pancake," generally designated by the numeral 150, which includes the cylindrical core 152 on which the ribbon is wound. As seen in FIGS. 11 and 12, the core 152 is formed with eight internal ribs 154, extending axially along its bore, which ribs 154 cooperate with the splines 66 on the shaft 62 of the spindle 58 to mount the ribbon pancake 150 there-upon for rotation therewith.

Figure 4:
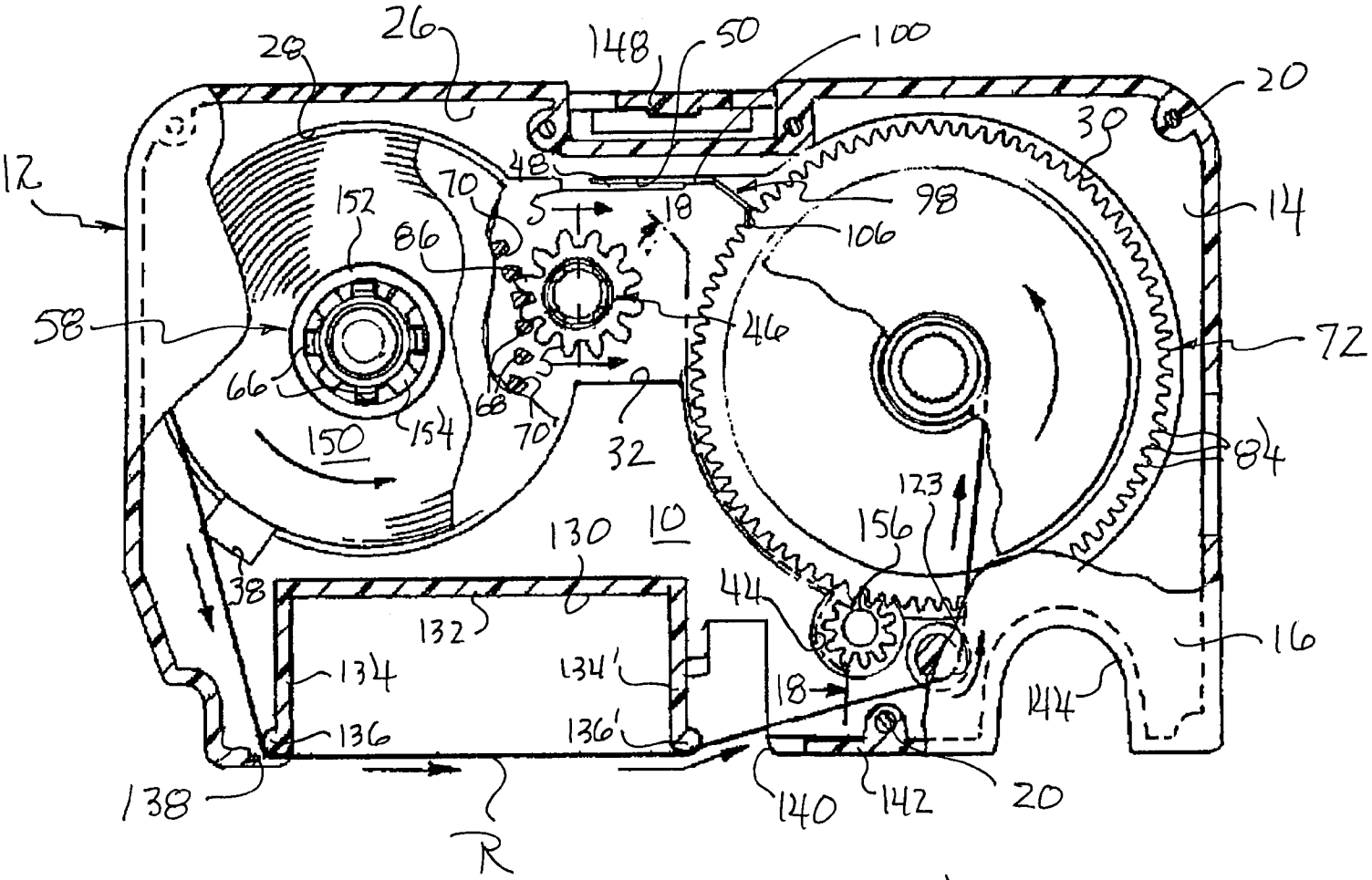
FIG. 4 is a fragmentary plan view of the cassette, in partial section, with portions of the cover component and the ribbon spindles broken away.

As best seen in FIG. 4, the drive gear 156 of the mailing machine protrudes through the opening 44 in the back wall 14 of the cassette base component 10, and is disposed in meshing engagement with the circumferential array of gear teeth 84 on the base portion 74 of the take-up spindle 72. As depicted in FIG. 18, engagement of the drive gear 156 occurs at a lower zone of the array of gear teeth 84 (taken with reference to a transaxial plane through the skirt portion 82), and consequently any wear that might be caused by the steel anti-reverse spring 98, which engages only the upper zone of the gear teeth array, will not affect the ability of the gear 156 to effectively drive the take-up spindle and, in turn, to advance the ribbon R through the cassette.

FIGS. 2 and 4 best indicate the travel path of the ribbon R through the cassette, with the arrows in FIG. 4 showing the direction of ribbon movement as well as the counterclockwise direction of pay-off from the spindle 58 and take-up upon the spindle 72. As is best seen in FIGS. 3 and 4, after spanning the print head-receiving recess 130 the ribbon R enters the opening 140 and passes about the curved surface 123 of the guide bar 122 before winding upon the take-up spindle 72. Not only does the guide bar serve to displace the ribbon R, so as to avoid interference with the thumb-print structure 146, 147, but it also cooperates to produce a desired level of tension on the ribbon (due in part to wrapping about a small radius member, which typically has a value of 1/16 to 1/4, and preferably 1/8 inch) and a desired take-up attack angle, while maintaining it in a smooth, unwrinkled condition, preventing its wandering, and improving its tracking.

Thus, is can be seen that the present invention provides a novel ink ribbon cassette for a mailing machine, which cassette avoids disadvantageous features of the cassettes known in the art and currently commercially available. Tension control and anti-reverse functions are achieved by means that are highly effective and yet relatively uncomplicated, thereby affording advantages in use and in the cost and facility of manufacture.

Having thus described the invention, what is claimed is:

1. A ribbon cassette for a mailing machine, said cassette having laterally adjacent ribbon supply and ribbon take-up sides, and including:

a housing comprised of an assembled base component and a mating cover component secured to one another and defining an interior space therewithin, said base component comprising a back wall, which faces rearwardly in the normal orientation of cassette operation, and said cover component comprising a front wall which faces forwardly in said normal orientation, one of said housing components including a peripheral wall extending about said housing and being comprised of an upper portion, a transversely spaced lower portion, and laterally spaced opposite end portions; said lower portion of said peripheral wall having an upwardly extending recess formed therein for receiving a print head assembly of a mailing machine, said recess being defined by an upper wall section and first and second lateral wall sections, said first and second lateral wall sections being spaced laterally with respect to one another and each having a lower edge; and said peripheral wall lower portion having an exit opening adjacent to and upstream of said first lateral wall section, taken with respect to the direction of ribbon travel from said supply side to said take-up side of said cassette, and having an entrance opening adjacent to and downstream of said second lateral wall section;

a fresh ribbon supply spindle and a used ribbon take-up spindle rotatably mounted upon said base component within said interior housing space on said supply side and said take-up side of said cassette, respectively, each of said spindles comprising a circular base having an array of gear teeth extending about the circumference thereof, and a center shaft extending substantially normal to said base for supporting a roll of fresh or used printing ribbon thereon, respectively;

an anti-reverse spring mounted upon said housing and having an outer end portion in engagement with said gear teeth of said take-up spindle, said anti-reverse spring being so configured and disposed as to permit rotation of said take-up spindle in a forward, ribbon-winding direction of said take-up spindle while preventing rotation of said take-up spindle in the reverse, ribbon-unwinding direction thereof;

a constant-tension drag arrangement comprised of a radially expansible stub axle projecting forwardly from said base component and having a bore extending thereinto from a free forward end thereof and on an axis substantially normal to said back wall, an expansion member projecting rearwardly from said cover component, substantially normal to said front wall, into said bore of said stub axle so as to cause said stub axle to be presented in an expanded state, and a gear having an axial aperture through which said stub axle extends to rotatably mount said gear thereon, said stub axle being positioned to dispose said gear in meshing engagement with said gear teeth of said supply spindle, said stub axle and gear aperture being so dimensioned and configured that, in said expanded state of said stub axle, a surface portion thereof frictionally engages the surface defining said gear aperture with a force that is sufficient to retard rotation of said gear and thereby to exert a significant drag force, of substantially constant magnitude, upon said supply spindle;

a guide bar extending transversely of said interior space of said housing, substantially normal to said back wall and said front wall of said base and cover components, respectively, and near said entrance opening in said lower portion of said peripheral wall of said housing, said guide bar having a guide surface that is offset laterally from a spanning line between said lower edge of said second lateral wall section and said center shaft of said take-up spindle, said offset being to the side of said spanning line opposite to the side thereof on which said lower edge of said second wall section of said peripheral lower wall portion is disposed, said housing being devoid of any wall portion providing underlying support for a ribbon in an area between said lower edge of said second lateral wall section and said take-up spindle; and a roll of postage-printing ribbon supported on said supply spindle in fixed relationship thereto for unwinding during rotation thereof, said ribbon having an end portion attached to said take-up spindle and traveling along a path from said supply spindle, outwardly of said housing through said exit opening, over said lower edges of said first and second lateral wall sections to span said print head assembly-receiving recess, back into said housing through said entrance opening, about said guide surface of said guide bar, and to said take-up spindle for winding thereupon.

2. The cassette of claim 1 wherein said cover component and said peripheral wall are integrally formed as a single piece with said peripheral wall extending generally perpendicular to said front wall of said cover component.

3. The cassette of claim 1 wherein said first and second lateral wall sections of said lower portion of said peripheral wall are of the same transverse length and terminate as smooth free edges of curvilinear cross section.

4. The cassette of claim 1 wherein said base of said supply spindle has a circumferential flange extending thereabout, said circumferential flange being formed with a multiplicity of substantially identical gaps therethrough, at equiangularly spaced locations entirely thereabout, so as to provide said array of gear teeth on said supply spindle.

5. The cassette of claim 1 wherein said anti-reverse spring has an inner end portion mounted adjacent said upper portion of said peripheral wall, one of said housing components being formed with structure for disengageably receiving said inner end portion of said anti-reverse spring in assembly with said one housing component, and the other of said housing components being formed with means for maintaining said inner end portion of said anti-reverse spring in such assembly.

6. The cassette of claim 1 wherein said stub axle of said constant-tension drag arrangement comprises a hollow post that is axially split, at a plurality of locations and from said free forward end thereof, to define a plurality of segments that are radially displaceable by said expansion member to said expanded state of said stub axle.

7. The cassette of claim 1 wherein one of said housing components has a multiplicity of fastening elements spaced thereabout and projecting therefrom toward the other of said housing components, and wherein said peripheral wall of said housing has an edge portion with a plurality of holes formed thereinto, said fastening elements being constructed to seat and fixedly engage within said holes, and being so seated and engaged to thereby secure said one housing component in assembly with said peripheral wall.

8. The cassette of claim 7 wherein said guide bar has a free outer end portion disposed in contact with said one housing component and into which a hole is formed, and wherein one of said fastening elements on said one housing component is so seated and engaged in said guide bar hole.

9. The cassette of claim 1 wherein said guide bar is generally rectilinear and has a smooth, curvilinear outer surface portion, providing said guide surface, extending along a substantial portion of the length of said guide bar.

10. The cassette of claim 1 wherein said second lateral wall section of said peripheral wall lower portion is of compound construction and has a segment, adjacent said front wall of said cover component, that is spaced laterally from said first lateral wall section beyond the remaining segment of said second lateral wall section to provide thumb-receiving recess structure that protrudes into said interior space within said housing, said guide bar serving to displace said ribbon from said spanning line so as to avoid interference between said ribbon and said inwardly protruding recess structure.

11. The cassette of claim 1 wherein said expansion member comprises a rod that extends generally normal to said front wall of said cover component.

12. The cassette of claim 1 wherein said gear teeth of said array on said base of said take-up spindle extend radially outwardly therefrom.

13. The cassette of claim 12 wherein said array of gear teeth on said base of said take-up spindle has an upper zone and a lower zone, defined by a transaxial plane, and wherein said engagement of said outer end portion of said anti-reverse spring is limited substantially to said upper zone of said array.

14. The cassette of claim 1 wherein said postage-printing ribbon is a thermal ink ribbon.

15. A ribbon cassette for a mailing machine, said cassette having laterally adjacent ribbon supply and ribbon take-up sides, and including:

a housing comprised of an assembled base component and a mating cover component secured to one another and defining an interior space therewithin, said base component comprising a back wall, which faces rearwardly in the normal orientation of cassette operation, and said cover component comprising a front wall which faces forwardly in said normal orientation, one of said housing components including a peripheral wall extending about said housing and being comprised of an upper portion, a transversely spaced lower portion, and laterally spaced opposite end portions; said lower portion of said peripheral wall having an upwardly extending recess formed therein for receiving a print head assembly of a mailing machine, said recess being defined by an upper wall section and first and second lateral wall sections, said first and second lateral wall sections being spaced laterally with respect to one another and each having a lower edge; and said peripheral wall lower portion having an exit opening adjacent to and upstream of said first lateral wall section, taken with respect to the direction of ribbon travel from said supply side to said take-up side of said cassette, and having an entrance opening adjacent to and downstream of said second lateral wall section;

a fresh ribbon supply spindle and a used ribbon take-up spindle rotatably mounted upon said base component within said interior housing space on said supply side and said take-up side of said cassette, respectively, each of said spindles comprising a circular base having an array of gear teeth extending about the circumference thereof, and a center shaft extending substantially normal to said base for supporting a roll of fresh or used printing ribbon thereon, respectively;

anti-reverse means in said housing for permitting rotation of said take-up spindle in a forward, ribbon-winding direction of said take-up spindle while preventing rotation of said take-up spindle in the reverse, ribbon-unwinding direction thereof;

a constant-tension drag arrangement comprised of a radially expansible stub axle projecting forwardly from said base component and having a bore extending thereinto from a free forward end thereof and on an axis substantially normal to said back wall, an expansion member projecting rearwardly from said cover component, substantially normal to said front wall, into said bore of said stub axle so as to cause said stub axle to be presented in an expanded state, and a gear having an axial aperture through which said stub axle extends to rotatably mount said gear thereon, said stub axle being positioned to dispose said gear in meshing engagement with said gear teeth of said supply spindle, said stub axle and gear aperture being so dimensioned and configured that, in said expanded state of said stub axle, a surface portion thereof frictionally engages the surface defining said gear aperture with a force that is sufficient to retard rotation of said gear and thereby to exert a significant drag force, of substantially constant magnitude, upon said supply spindle; and a roll of postage-printing ribbon supported on said supply spindle in fixed relationship thereto for unwinding during rotation thereof, said ribbon having an end portion attached to said take-up spindle and traveling along a path from said supply spindle, outwardly of said housing through said exit opening, over said lower edges of said first and second lateral wall sections to span said print head assembly-receiving recess, back into said housing through said entrance opening, about said guide surface of said guide bar, and to said take-up spindle for winding thereupon.

16. The cassette of claim 15 wherein said stub axle of said constant-tension drag arrangement comprises a hollow post that is axially split, at a plurality of locations and from said free forward end thereof, to define a plurality of segments that are radially displaceable by said expansion member to said expanded state of said stub axle.

17. The cassette of claim 16 wherein said expansion member comprises a rod that extends generally normal to said front wall of said cover component.

18. A ribbon cassette for a mailing machine, said cassette having laterally adjacent ribbon supply and ribbon take-up sides, and including:

a housing comprised of an assembled base component and a mating cover component secured to one another and defining an interior space therewithin, said base component comprising a back wall, which faces rearwardly in the normal orientation of cassette operation, and said cover component comprising a front wall which faces forwardly in said normal orientation, one of said housing components including a peripheral wall extending about said housing and being comprised of an upper portion, a transversely spaced lower portion, and laterally spaced opposite end portions; said lower portion of said peripheral wall having an upwardly extending recess formed therein for receiving a print head assembly of a mailing machine, said recess being defined by an upper wall section and first and second lateral wall sections, said first and second lateral wall sections being spaced laterally with respect to one another and each having a lower edge; and said peripheral wall lower portion having an exit opening adjacent to and upstream of said first lateral wall section, taken with respect to the direction of ribbon travel from said supply side to said take-up side of said cassette, and having an entrance opening adjacent to and downstream of said second lateral wall section;

a fresh ribbon supply spindle and a used ribbon take-up spindle rotatably mounted upon said base component within said interior housing space on said supply side and said take-up side of said cassette, respectively, each of said spindles comprising a circular base having an array of gear teeth extending about the circumference thereof, and a center shaft extending substantially normal to said base for supporting a roll of fresh or used printing ribbon thereon, respectively;

anti-reverse means in said housing for permitting rotation of said take-up spindle in a forward, ribbon-winding direction of said take-up spindle while preventing rotation of said take-up spindle in the reverse, ribbon-unwinding direction thereof;

a drag arrangement for exerting a significant drag force, of substantially constant magnitude, upon said supply spindle;

a guide bar extending transversely of said interior space of said housing, substantially normal to said back wall and said front wall of said base and cover components, respectively, and near said entrance opening in said lower portion of said peripheral wall of said housing, said guide bar having a guide surface that is offset laterally from a spanning line between said lower edge of said second lateral wall section and said center shaft of said take-up spindle, said offset being to the side of said spanning line opposite to the side thereof on which said lower edge of said second wall section of said peripheral lower wall portion is disposed, said housing being devoid of any wall portion providing underlying support for a ribbon in an area between said lower edge of said second lateral wall section and said take-up spindle; and a roll of postage-printing ribbon supported on said supply spindle in fixed relationship thereto for unwinding during rotation thereof, said ribbon having an end portion attached to said take-up spindle and traveling along a path from said supply spindle, outwardly of said housing through said exit opening, over said lower edges of said first and second lateral wall sections to span said print head assembly-receiving recess, back into said housing through said entrance opening, about said guide surface of said guide bar, and to said take-up spindle for winding thereupon.

19. The cassette of claim 18 wherein said guide bar is generally rectilinear and has a smooth, curvilinear outer surface portion, providing said guide surface, extending along a substantial portion of the length of said guide bar.

20. The cassette of claim 19 wherein said curvilinear outer surface portion of said guide bar has a radius of about 1/16 to 1/4 inch.

21. The cassette of claim 18 wherein said second lateral wall section of said peripheral wall lower portion is of compound construction and has a segment, adjacent said front wall of said cover component, that is spaced laterally from said first lateral wall section beyond the remaining segment of said second lateral wall section to provide thumb-receiving recess structure that protrudes into said interior space within said housing, said guide bar serving to displace said ribbon from said spanning line so as to avoid interference between said ribbon and said inwardly protruding recess structure.

22. The cassette of claim 18 wherein said postage-printing ribbon is a thermal ink ribbon.

* * * * *